United States Patent [19]

Aldridge et al.

[11] Patent Number: 4,817,210

[45] Date of Patent: Apr. 4, 1989

[54] PROTECTIVE COAT FOR FIREFIGHTERS

[75] Inventors: Don Aldridge, New Carlisle; Rolf U. Metzger, Fairborn, both of Ohio

[73] Assignee: Lion Apparel, Inc., Dayton, Ohio

[21] Appl. No.: 174,198

[22] Filed: Mar. 28, 1988

[51] Int. Cl.[4] ..... A41D 1/02; A41D 13/00

[52] U.S. Cl. ..... 2/81; 2/93; 2/246; 2/87

[58] Field of Search ..... 2/81, 82, 93, 94, 97, 2/87

[56] References Cited

U.S. PATENT DOCUMENTS

| | | | |
|---|---|---|---|
| 4,507,806 | 4/1985 | Coombs | 2/81 X |
| 4,710,981 | 12/1987 | Sanchez | 2/246 X |
| 4,768,233 | 9/1988 | Grilliot et al. | 2/81 |

*Primary Examiner*—H. Hampton Hunter

*Attorney, Agent, or Firm*—Killworth, Gottman, Hagan & Schaeff

[57] ABSTRACT

A protective coat for firefighters comprises an outer shell, an inner liner and a flap. The outer shell has a front and back portion defining a neck opening and right and left sleeve openings, and right and left sleeves attached to the right and left sleeve openings, the back portion having a lower edge. The inner liner also has a front and back portion defining a neck opening and right and left sleeve openings, and right and left sleeves attached to the right and left sleeve openings, the back portion having a lower edge. The sleeves of the inner liner are insertable within the sleeves of the outer shell and the neck openings are coincident so that the inner liner is secured within the outer shell. The flap is extendable downwardly in a first position below the lower edge of the back portions of the outer shell and inner liner and is foldable upwardly in a second position thereabove to provide a visual indication that the inner liner is missing.

22 Claims, 2 Drawing Sheets

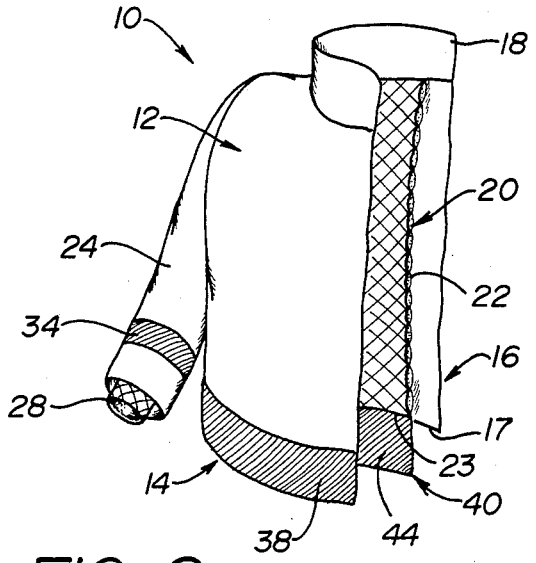
FIG-1
FIG-2
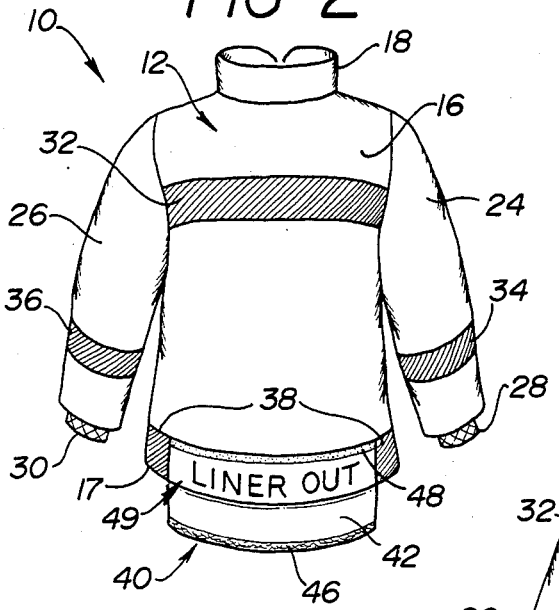
FIG-3
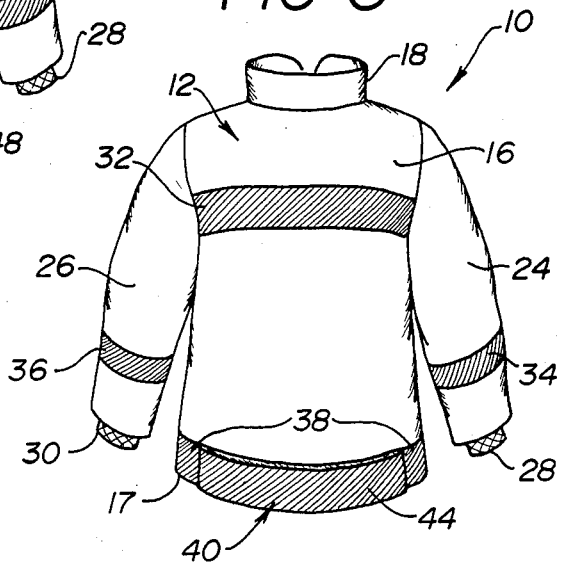

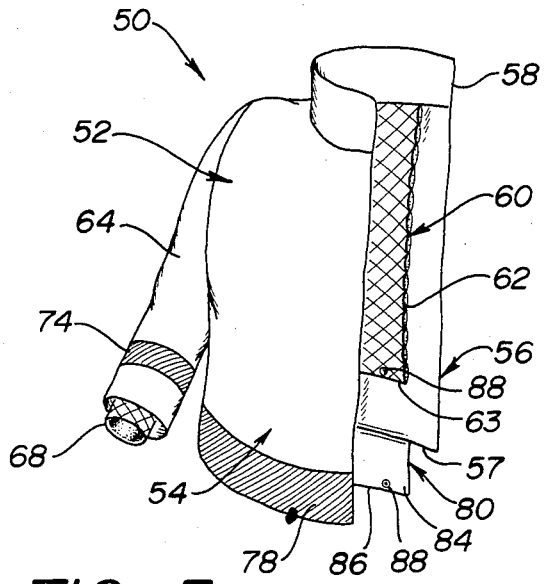
FIG-4
FIG-5
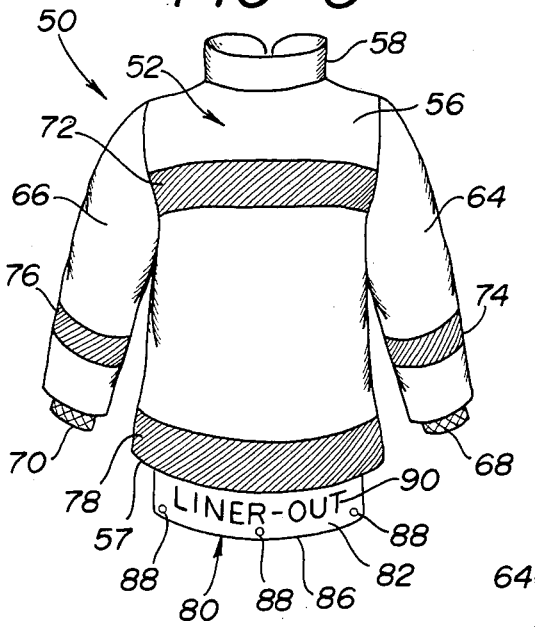
FIG-6
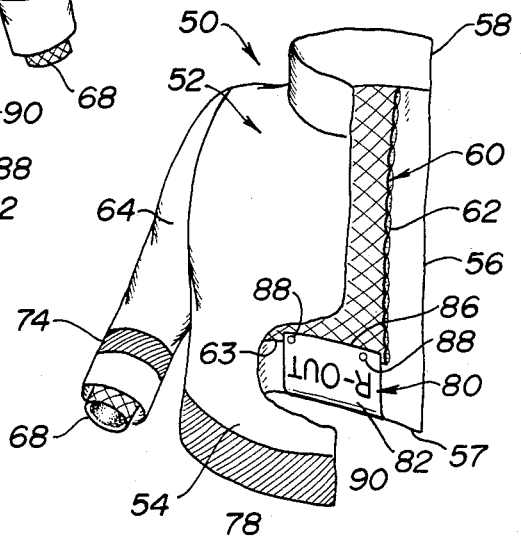

PROTECTIVE COAT FOR FIREFIGHTERS

BACKGROUND OF THE INVENTION

The present invention relates to a protective coat and, more particularly, to a protective coat for protecting firefighters from fire and the heat associated therewith.

In suppressing a fire, firefighters are exposed to an extremely dangerous environment which includes falling debris, moisture, smoke, flames and intense heat. To protect himself from this hostile environment, the firefighter wears protective equipment, including a helmet, a protective coat, upper leg protection, boots and glooves. The protective coat typically comprises an outer shell having a collar and an inner liner inserted within the outer shell. The outer shell is a tough fabric designed to shed water and resist flame; whereas, the inner liner is a multi-layer fabric construction designed to thermally insulate the firefighter from extraordinary heat as well as prevent the passage of water or water vapor through the liner. In some protective coats, the inner liner is detachable to aid in washing and drying when the coat is not being used.

When the firefighter responds to an alarm, the coat should never be missing the inner liner. It may happen, however, that the firefighter accidentally forgets to insert the liner into the outer shell or that he intentionally decides not to insert the liner because the weather is too hot or because the liner is still wet from being washed or from being used during a previous fire. The firefighter might also decide not to insert the inner liner because of a belief that tha alarm was for an emergency other than fire suppression or that the liner is only for winter use. In any case, when the firefighter responds to an alarm wearing a coat without the liner, the life of the firefighter is seriously jeopardized because the firefighter is not thermally protected. Furthermore, failure to insert the inner liner may violate regulations which require that the liner should be worn in order to protect the firefighters from physical injury. Therefore, the person responsible for supervising the firefighters needs a way to be visually assured that all of the firefighters are wearing coats having the inner liner. Since there may be many firefighters at the scene of a fire and since the condition at the scene of the fire is quite hectic, the supervisor must be able to check the coat of each firefighter quickly and easily at one glance and be reasonably assured to the inner liner is present without having to needlessly interrupt the firefighters to check the coats.

A protective garment or coat is disclosed in U.S. Pat. No. 4,507,806, issued Apr. 2, 1985, and comprises an outer shell having an annular tab extending from the neck of the outer shell, an inner liner, and a collar attached to the inner liner rather than the outer shell. The tab is fabricated from a bright fluorescent material and is covered by the collar of the inner liner when the coat is fully assembled so that the bright fluorescent material does not show. Therefore, when the firefighter is wearing this coat, the presence of the bright tab should be an immediate indication to the supervisor that the coat is missing the liner.

In several situations, however, this coat may fail to provide an immediate indication that the liner is missing. First, it is possible that the bright tab may be obstructed from view by something other than the collar of the liner. For example, a regular shirt collar could be pulled through the neck opening in the outer shell to cover the tab in the absence of the liner. The tab could also be obstructed by facial hair. Second, it is possible that the bright tab might be obstructed from view while the firefighter is trying to extinguish the fire with his back toward the supervisor, e.g., it might be obstructed from view by the bill of the helmet worn by the firefighter or by the firefighter's hair. Thus, the location of a bright tab under the liner collar does not necessarily provide an easy or quick indication that the inner liner is missing.

Accordingly, there is a need for a protective coat that the supervisor can check with a single glance to determine quickly and easily that the liner is missing, without having to interrupt the firefighter needlessly while the firefighter attempts to extinguish the fire.

SUMMARY OF THE INVENTION

The present invention meets these needs by providing a protective coat for firefighters which comprises an outer shell, an inner liner and a flap. The outer shell has a front and back portion defining a neck opening and right and left sleeve openings, and right and left sleeves attached to the right and left sleeve openings, the back portion having a lower edge. The inner liner also has front and back portions defining a neck opening and right and left sleeve openings, and right and left sleeves attached to the right and left sleeve openings of the liner, the back portion having a lower edge. The sleeves of the inner liner are insertable within the sleeves of the outer shell and the neck openings are coincident so that the inner liner is securable within the outer shell.

In a first embodiment of the coat, the flap is attached to the lower edge of the inner liner, the flap being extendable downwardly therefrom in a first position and foldable upwardly over the lower edge of the outer shell in a second position. Such coat further comprises warning indicia attached to the back portion of the outer shell adjacent the lower edge thereof to provide a visual indication that the inner liner is missing when the flap not in said second position and not in said first position.

In a second embodiment of the coat, the flap is attached to the lower edge of the outer shell, the flap being extendable downwardly therefrom in a first position and foldable upwardly over the lower edge of the inner liner in a second position. Such coat further comprises warning indicia attached to the flap to provide a visual indication that the inner liner may be missing when the flap is in the first position.

Accordingly, it is an object of the present invention to provide a protective coat for firefighters which provides a visual indication that the liner is missing from the outer shell; to provide a visual indication that can be easily and quickly checked; to provide a visual indication that cannot be easily obstructed; and to provide a visual indication wherein the supervisor can be reasonably assured of the assessment without having a needlessly interupt the firefighters while suppressing a fire.

Other objects and advantages of the invention will be apparent from the following description, the accompanying drawings and the appended claims.

BRIEF DESCRIPTION OF THE DRAWINGS

FIG. 1 is a front view, partially cut away, of a first embodiment of a protective coat including a flap, constructed according to the present invention.

FIG. 2 is a back view of the protective coat of FIG. 1 showing the flap in a first position;

FIG. 3 is a back view, similar to FIG. 2, showing the flap in a second position;

FIG. 4 is a front view, partially cut away, of a second embodiment of a protective coat including a flap, constructed according to the present invention;

FIG. 5 is a back view of the protective coat of FIG. 4 showing the flap in a first position; and FIG. 6 is a front view, similar to FIG. 4, showing the flap in a second position.

DETAILED DESCRIPTION OF THE PREFERRED EMBODIMENTS

Referring to FIGS. 1 to 3, a first embodiment of a protective coat for a firefighter is shown generally at 10 and comprises an outer shell 12 having a front portion 14 and a back portion 16. The shell 12 defines a neck opening and right and left sleeve openings, a collar 18 attached to the outer shell 12 adjacent the neck opening, and an inner liner, indicated generally at 20, having a front portion (not shown) and a back portion 22 defining a neck opening and right and left sleeve openings. It is to be understood that the collar 18 or another collar could be attached to the inner liner 20 adjacent its neck opening without departing from the scope of the invention.

The back portion 16 of the outer shell 12 has a lower edge 17 at the opposite end from the neck opening. The back portion 22 of the inner liner 20 has a lower edge 23 at the opposite end from the neck opening. The outer shell 12 further comprises a right sleeve 24 and a left sleeve 26 attached to the shell 12 adjacent the corresponding sleeve openings. The inner liner 20 further comprises a right sleeve 28 and a left sleeve 30 attached to the liner 20 adjacent the corresponding sleeve openings. When the sleeves 28, 30 of the inner liner 20 are inserted within the sleeves 24, 26 of the outer shell 12 and the neck openings are coincident, the inner liner 20 is secured within the outer shell 12. The outer shell 12 is a tough fabric designed to shed water and resist flame, while the inner liner 20 is a multi-layer construction designed to thermally insulate the firefighter from extraordinary heat and to prevent the passage of water or water vapor through the liner.

A strip of material 32 is attached to the back portion 16 of the outer shell 12. The strip of material 32 is preferably a bright, fluorescent color which contrasts with the color of the outer shell 12. Strips of material 34, 36 of the same color are attached to the right and left sleeves 24, 26 of the outer shell 12. Additionally, a strip of material or trim band 38 of the same color is attached to the lower hemline of the outer shell 12. Band 38 must extend around the entire circumference according to the standards of the National Fire Protection Association, as discussed in more detail below. Preferably, strips 32, 34, 36 and 38 may be made of a material which is retroreflective, as required by National Fire Protection Association standards.

A flap 40 is attached to the lower edge 23 of the back portion 22 of the inner liner 20. The flap 40 extends downwardly below the lower edge 17 of the back portion 16 of the outer shell 12. The flap 40 has an outer surface 42 and an inner surface 44 which is preferably a fluorescent color, in contrast with the colors of the outer surface 42 and the outer shell 12. The flap 40 extends downwardly below the lower edge 17 of the back portion 16 of the outer shell 12 in a first position as shown in FIG. 2, and is foldable around the lower edge 17 in a second position as shown in FIG. 3. The inner surface 44 of the flap 40 is a fluorescent color, and is contiguous with the trim band 38 when the flap 40 is folded in the second position so that a bright colored band extends around the full circumference of the lower hemline of the outer shell 12, as required by National Fire Protection Association Standards. The band is also preferably retroreflective, as required by National Fire Protection Association standards.

The coat 10 further comprises means for removably fastening the lower periphery 46 of outer surface 42 of the flap 40 to an opposing surface 48 of the back portion 16 of the outer shell 12 when the flap 40 is folded in the second position. The fastening means typically comprises mating strips of hook and loop material, such as Velcro®, attached to the periphery 46 of the outer surface 42 of the flap 40 and to the opposing surface 48 of the back portion 16 of the outer shell 12. However, a zipper, snaps, or other suitable fastening means may be used without departing from the scope of the invention, as long as the fastening means may be used to hold the flap 40 in the second position. When the flap 40 is in the second position, the inner surface 44 provides a visual indication that the inner liner 20 is secured within the outer shell 12 because it reestablishes the clearly visible circumferential trim band with the trim band 38. In the first position, the circumferential trim line is broken as shown in FIG. 2.

The coat 10 further comprises warning indicia, indicated generally at 49, mounted on to the back portion 16 of the outer shell 12 adjacent the lower edge 17 thereof and coverable by the flap 40 when the flap is folded in the second position. If the inner liner 20 has not been secured within the outer shell 12, the indicia 49 provide a visual indication that the inner liner 20 is missing. Thus, the indicia 49 and the absence of the flap 40 provide an indication that the inner liner 20 is missing, while the fluorescent, retroreflective inner surface 44 in position when the flap covers indicia 49 provides an indication that the inner liner 20 is present, i.e., a dual indication. The indicia 49 can also be retroreflective and a fluorescent color, in contrast with the color of the outer shell 12, to provide greater visibility.

Referring to FIGS. 4 to 6, a second embodiment of a protective coat for a firefighter is shown generally at 50 and comprises an outer shell 52 having a front portion 54 and a back portion 56. The shell 52 defines a neck opening and right and left sleeve openings, a color 58 attached to the outer shell 52 adjacent the neck opening, and an inner liner, indicated generaly at 60, having a front portion (not shown) and a back portion 62 defining a neck opening and right and left sleeve openings. It is to be understood that the collar 58 or another collar could be attached to the inner liner 60 adjacent its neck opening without departing from the scope of the invention.

The back portion 56 of the outer shell 52 has a lower edge 57 at the opposite end from the neck opening. The back portion 62 of the inner liner 60 has a lower edge 63 at the opposite end from the neck opening. The outer shell 52 further comprises a right sleeve 64 and a left sleeve 66 attached to the shell 52 adjacent the corresponding sleeve openings. The inner liner 60 further comprises a right sleeve 68 and a left sleeve 70 attached to the liner 60 adjacent the corresponding sleeve openings. When the sleeves 68, 70 of the inner liner 60 are inserted within the sleeves 64, 66 of the outer shell 52 and the neck openings are coincident, the inner liner 60 is secured within the outer shell 52.

A strip of material 72 is attached to the back portion 56 of the outer shell 52. The strip of material 72 is preferably retroreflective and a fluorescent color which contrasts with the color of the outer shell 52. Strips of material 74, 76 of the same color are attached to the right and left sleeves 64, 66 of the outer shell 52. Additionally, a strip of material or trim band 78 of the same color is attached to the lower hemline of the outer shell 55, and extends around the entire circumference in compliance with industry standards. If desired, the strips 72, 74, 75 and 78 may be made of a material which is retroreflective in compliance with these standards.

A flap 80 is attached to the lower edge 57 of the back portion 56 of the outer shell 52 and has an outer surface 82 and an inner surface 84. The flap 80 extends downwardly in a first position as shown in FIGS. 4 and 5, and is folded up to the lower edge 63 of the inner liner 60 in a second positions as shown in FIG. 6. The coat 50 further comprises means for removably fastening the lower periphery 86 of the flap 80 to the periphery of the lower edge 63 of the inner liner 60 when the flap 80 is folded in the second position. The fastening means shown comprises mating snaps 88 attached to the lower periphery 86 of the flap 80 and the periphery of the lower edge 63 of the inner liner 60. However, a zipper, Velcro, or other suitable fastening means may be used without departing from the spirit and scope of the invention, as long as the fastening means holds the flap 80 in the second position.

The coat 50 further comprises warning indicia 90 mounted on the outer surface 82 of the flap 80. Thus, the indicia 90 are inside the coat 50 when flap 80 is folded in the second position. If the inner liner 60 has not been secured within the outer shell 52, the flap 80 remains in the first position because it cannot be snapped to the lower edge 63 of the inner liner 60. As a result, the presence of the downwardly extending flap 80 and the indicia 90 thereon provides an indication that the inner liner 60 is missing, while their absence indicates that the inner liner 60 has been inserted in the shell. The indicia 90 may be retroreflective and preferably a fluorescent color, in contrast with the color of the outer shell 52, to provide greater visibility.

Both embodiments of the invention provide the firefighter's supervisor with a visual indication that the inner liner 20 or 60 is missing, i.e., the exposure of the indicia 49 or 90, respectively, and in the case of the first embodiment, the absence of flap 40. The supervisor can quickly and easily determine whether the inner liner 20, 60 has been secured within the outer shell 12, 52. The position of the flap 40, 80 is such that it is highly visible and not likely to be hidden from view. Thus, the supervisor will not needlessly interrupt the firefighters.

Having described the invention in detail and by was of reference to preferred embodiments thereof, it will be apparent that other modifications and variations are possible without departing from the scope of the invention defined in the appended claims.

What is claimed is:

1. A protective coat for firefighters, comprising:

an outer shell having a front and back portion defining a neck opening and right and left sleeve openings, and right and left sleeves attached to the right and left sleeve openings, respectively, the back portion of said outer shell having a lower edge;

an inner liner having a front and back portion defining a neck opening and right and left sleeve openings, and right and left sleeves attached to the right and left sleeve openings of said inner liner, respectively, the sleeves of said inner liner being insertable within the sleeves of said outer shell with the neck openings being coincident so that said inner liner is secured within said outer shell, the back portion of said inner liner having a lower edge; and a flap of material secured to one of said outer shell and said inner liner extendable downwardly in a first position below the lower edge of the back portions of said outer shell and said inner liner, and foldable upwardly in a second position thereabove and separable fastening means for securing said flap in said second position to the other of said outer shell and said inner liner, said flap providing a visual indication that said inner liner is not missing when in said second position.

2. A protective coat is recited in claim 1, wherein said outer shell is flame-resistant and said inner liner is heat-resistant.

3. A protective coat as recited in claim 1, wherein said flap is attached to the lower edge of the back portion of said inner liner and extends downwardly therefrom in the first position and is foldable over the lower edge of the back portion of said outer shell in the second position.

4. A protective coat is recited in claim 3, wherein said separable fastening means comprises means for removably fastening said flap to the back portion of said outer shell in the second position.

5. A protective coat as recited in claim 4, wherein said means for fastening comprises mating strips of adhesive-like fiber.

6. A protective coat as recited in claim 3, further comprising warning indicia, attached to the back portion of said outer shell adjacent the lower edge thereof, to provide a visual indication that said inner liner is missing when said flap is in the first position.

7. A protective coat is recited in claim 6, wherein said warning indicia are brightly colored in contrast with the color of said outer shell.

8. A protective coat as recited in claim 3, wherein said flap has a fluorescent colored, retroreflective inner surface to provide a visual indication that said inner liner is secured within said outer shell when said flap is folded in the second position.

9. A protective coat as recited in claim 1, wherein said flap is attached to the lower edge of the back portion of said outer shell and extends downwardly therefrom in the first position and is foldable over the lower edge of the back portion of said inner liner in the second position.

10. A protective coat as recited in claim 9, wherein said separable fastening means comprises means for removably fastening said flap to the back portion of said inner liner in the second position.

11. A protective coat as recited in claim 11, wherein said means for fastening comprises mating halves of snaps.

12. A protective coat as recited in claim 9, further comprising warning indicia attached to said flap to provide a visual indication that said inner liner is missing when said flap is in the first position.

13. A protective coat as recited in claim 12, wherein said warning indicia are brightly colored in contrast with the color of said outer shell.

14. A protective coat for firefighters, comprising:

an outer shell having front and back shell portions defining a shell neck opening and right and left shell sleeve openings, and right and left shell sleeves attached to the right and left shell sleeve openings, the back shell portion having a lower shell edge;

an inner liner having front and back liner portions defining a liner neck opening and right and left liner sleeve openings, and right and left liner sleeves attached to the right and left liner sleeve openings, the liner sleeves being insertable within the shell sleeves and the neck openings being coincident so that said inner liner may be secured within said outer shell, the back liner portion having a lower liner edge;

a flap attached to the lower liner edge, said flap being extendable downwardly therefrom in a first position and foldable upwardly over the lower shell edge in a second position; separable fastening means for securing said flap to said outer shell in said second position warning indicia attached to the back shell portion adjacent the lower edge thereof to provide a visual indication that said inner liner is missing when not covered by said flap in said second position.

15. A protective coat as recited in claim 14, wherein said outer shell is flame-resistant and said inner liner is heat-resistant.

16. A protective coat as recited in claim 14, wherein said indicia are brightly colored in contrast with the colors of said outer shell.

17. A protective coat as recited in claim 14, wherein said fastening means comprises mating strips of hook and loop material.

18. A protective coat is recited in claim 14, wherein said flap has a fluorescent colored, retroreflective inner surface to provide a visual indication that said inner liner is secured within said outer shell when said flap is folded in the second position.

19. A protective coat for firefighters, comprising:

an outer shell having front and back shell portions defining a shell neck opening and right and left shell sleeve openings, and right and left shell sleeves attached to the right and left shell sleeve openings, the back shell portion having a lower shell edge;

an inner liner having front and back liner portions defining a liner neck opening and right and left liner sleeve openings, and right and left liner sleeves attached to the right and left liner sleeve openings, the liner sleeves being insertable within the shell sleeves and the neck openings being coincident so that said inner liner may be secured within said outer shell, the back liner portion having a lower liner edge;

a flap attached to the lower shell edge, said flap being extendable downwardly therefrom in a first position and foldable upwardly over the lower liner edge in a second position; and separable fastening means for securing said flap to said inner liner in said second position and, warning indicia attached to said flap to provide a visual indication that said inner liner may be missing when said flap is in the first position.

20. A protective coat as recited in claim 14, wherein said outer shell is flame-resistant and said inner liner is heat-resistant.

21. A protective coat as recited in claim 14, wherein said indicia are brightly colored in contrast with the colors of said outer shell.

22. A protective coat as recited in claim 19, wherein said fastening means comprises mating halves of snaps.

* * * * *

UNITED STATES PATENT AND TRADEMARK OFFICE

CERTIFICATE OF CORRECTION

PATENT NO. : 4,817,210

DATED : April 4, 1989

INVENTOR(S) : Don Aldridge and Rolf Metzger

It is certified that error appears in the above-identified patent and that said Letters Patent is hereby corrected as shown below:

Col. 1, line 33 "tha" should be --the--.

Col. 1, line 49 "to" should be --of--.

Col. 2, line 59 "a" should be --to--.

Col. 5, line 21 "Fig. 6" should be --Fig. 3--.

Col. 5, line 57 "was" should be --way--.

Col. 6, line 41 "is" should be --as--.

Col. 6, line 59 "11" should be --10--.

Col. 7, line 36 "is" should be --as--.

Signed and Sealed this

Nineteenth Day of December, 1989

*Attest:*

JEFFREY M. SAMUELS

*Attesting Officer* *Acting Commissioner of Patents and Trademarks*